US008359993B1

(12) United States Patent
Harris et al.

(10) Patent No.: US 8,359,993 B1
(45) **Date of Patent: *Jan. 29, 2013**

(54) METHOD AND DEVICE FOR RELEASABLY LATCHING A WATER VESSEL TO A LINE

(75) Inventors: Donald Barnett Harris, Arlington, VA (US); Willard Sokol, III, Virginia Beach, VA (US); Robert J Galway, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/154,554

(22) Filed: Jun. 7, 2011

Related U.S. Application Data

(62) Division of application No. 12/378,584, filed on Feb. 11, 2009, now Pat. No. 7,975,638.

(51) Int. Cl.
*B63B 21/00* (2006.01)

(52) U.S. Cl. ..... 114/230.3

(58) Field of Classification Search ..... 114/230.1, 114/230.2, 230.25, 230.26, 230.28, 230.29, 114/230.3, 343, 354, 364, 218
See application file for complete search history.

(56) References Cited

U.S. PATENT DOCUMENTS

| | | | | |
|---|---|---|---|---|
| 3,013,517 | A * | 12/1961 | Isham | 294/110.1 |
| 3,166,038 | A | 1/1965 | Brittain et al. | |
| 3,613,629 | A | 10/1971 | Rhyne et al. | |
| 3,735,722 | A * | 5/1973 | Hooper et al. | 114/248 |
| 4,073,255 | A | 2/1978 | Paul | |
| 4,516,517 | A | 5/1985 | Ayers | |
| 5,378,851 | A | 1/1995 | Brooke et al. | |
| 5,941,191 | A | 8/1999 | Dysarz | |
| 6,662,741 | B1 | 12/2003 | Van Der Laan | |
| 6,745,716 | B2 | 6/2004 | Belyeu | |

* cited by examiner

*Primary Examiner* — Daniel Venne
(74) *Attorney, Agent, or Firm* — David A. Ghatt

(57) ABSTRACT

A method and device to permit a water vessel to releasably capture a line. The water vessel may include a step cutout portion to receive a line capturing device. The line capturing device includes a device housing having a capturing notch and a pivotal guide arm. The guide arm may be pivoted to a deployed position. When presented with a line, a water vessel with the line-capturing device may capture the line by deploying the guide arm to guide the line into the notch, where the line is releasably latched. Also included is a system for towing a smaller water vessel to a parent vessel, the smaller water vessel including a device for capturing a line. The line may be attached at one end to the parent vessel.

8 Claims, 10 Drawing Sheets

METHOD AND DEVICE FOR RELEASABLY LATCHING A WATER VESSEL TO A LINE

CROSS-REFERENCE TO RELATED APPLICATIONS

This is a divisional of U.S. patent application Ser. No. 12/378,584 filed Feb. 11, 2009, now pending, which is hereby incorporated by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and a water vessel mooring apparatus for the releasable latching of a water vessel to a line.

BACKGROUND

Larger parent ships often recover smaller surface water vessels, such as manned or unmanned surface water vessels (USVs). Once recovered by the parent ship, servicing operations on the smaller vessels may be performed. Typically, the recovery of a smaller vessel is accomplished by driving the smaller vessel alongside a stationary parent ship and lifting the smaller vessel by davit into the parent ship. Alternatively, the smaller water vessel may be driven up a ramp into the larger ship.

Traditional methods of capturing smaller surface water vessels can cause damage to the hull of the smaller vessel. For example, some USVs weigh about 20,000 pounds or more, and are made from materials such as aluminum and the like. A capturing method that for example, requires the USV to be driven into a parent ship in an uncontrolled manner can cause damage to the hull, resulting in expensive repairs and loss of operation. Similarly, smaller vessels may incur damage when driven alongside a parent ship prior to being lifted onto the ship.

SUMMARY

In one aspect, the invention is a water vessel mooring device for releasably capturing a line for the recovery of a water vessel. In this aspect, the water vessel mooring device includes a housing having a line-capturing notch. The line-capturing notch has a top lip portion and a lower lip portion. The water vessel mooring device further includes a hinged guide arm for guiding a line within the housing, the hinged guide arm pivotally connected to the housing wherein the hinged guide arm is pivotable between a stowed position and a deployed position. In the deployed position the guide arm forms a continuous extension of the lower lip portion. According to the invention, the water vessel mooring device includes a latching mechanism within the housing for latching the line within the housing.

In another aspect, the invention is a water vessel for releasably capturing a line. The water vessel has a hull body having a bow end and a stern end. In this aspect, a line-capturing device is attached to the hull body at the bow end. The line-capturing device has a housing having a line-capturing notch, the line-capturing notch having a top lip portion and a lower lip portion. In this aspect, the line-capturing device further includes a hinged guide arm for guiding a line within housing, the hinged guide arm pivotally connected to the housing. The hinged guide arm is pivotable between a stowed position and a deployed position, and in the deployed position the guide arm forms a continuous extension of the lower lip portion. The line-capturing device further includes a latching mechanism within the housing for latching the line within the housing.

In another aspect, the invention is a method of releasably capturing a line in open water. The method includes the providing of a water vessel on the open water, the water vessel having a hull body having a bow end and an aft end. In this aspect, the water vessel includes a line-capturing device having a housing attached to the hull body at the bow end. The method further includes the presenting of a line in the body of water, the directing of the water vessel, bow-first, towards the line, and the guiding of the line into the line-capturing device. In this aspect, the method further includes the latching of the line within the housing of the line-capturing device.

In yet another aspect, the invention is a water vessel for capturing a line for the mooring of the water vessel. The water vessel includes a hull body having a stern end and a bow end. The bow end of the hull body comprises a step cutout bordered by a surrounding bow surface. The step cutout has a first substantially triangular bow surface within the hull body, and a second substantially triangular bow surface within the hull body.

In another aspect, the invention is a system for towing a smaller water vessel to a parent vessel. The system includes a parent vessel having an attached line extending from the parent vessel, and a smaller water vessel having a line-capturing device. In this aspect, the line-capturing device includes a housing having a line-capturing notch. The notch has a top lip portion and a lower lip portion. The line-capturing device also includes a hinged guide arm for guiding a line within housing. The hinged guide arm is pivotally connected to the housing, at which the hinged guide arm is pivotable between a stowed position and a deployed position. In the deployed position the guide arm forms a continuous extension of the lower lip portion. In this aspect, the line-capturing device further includes a latching mechanism within the housing at the line-capturing notch, wherein the latching mechanism clamps the line thereby attaching the smaller water vessel to the parent vessel.

BRIEF DESCRIPTION OF THE DRAWINGS

Other features will be apparent from the description, the drawings, and the claims.

DETAILED DESCRIPTION

Figure 1A:
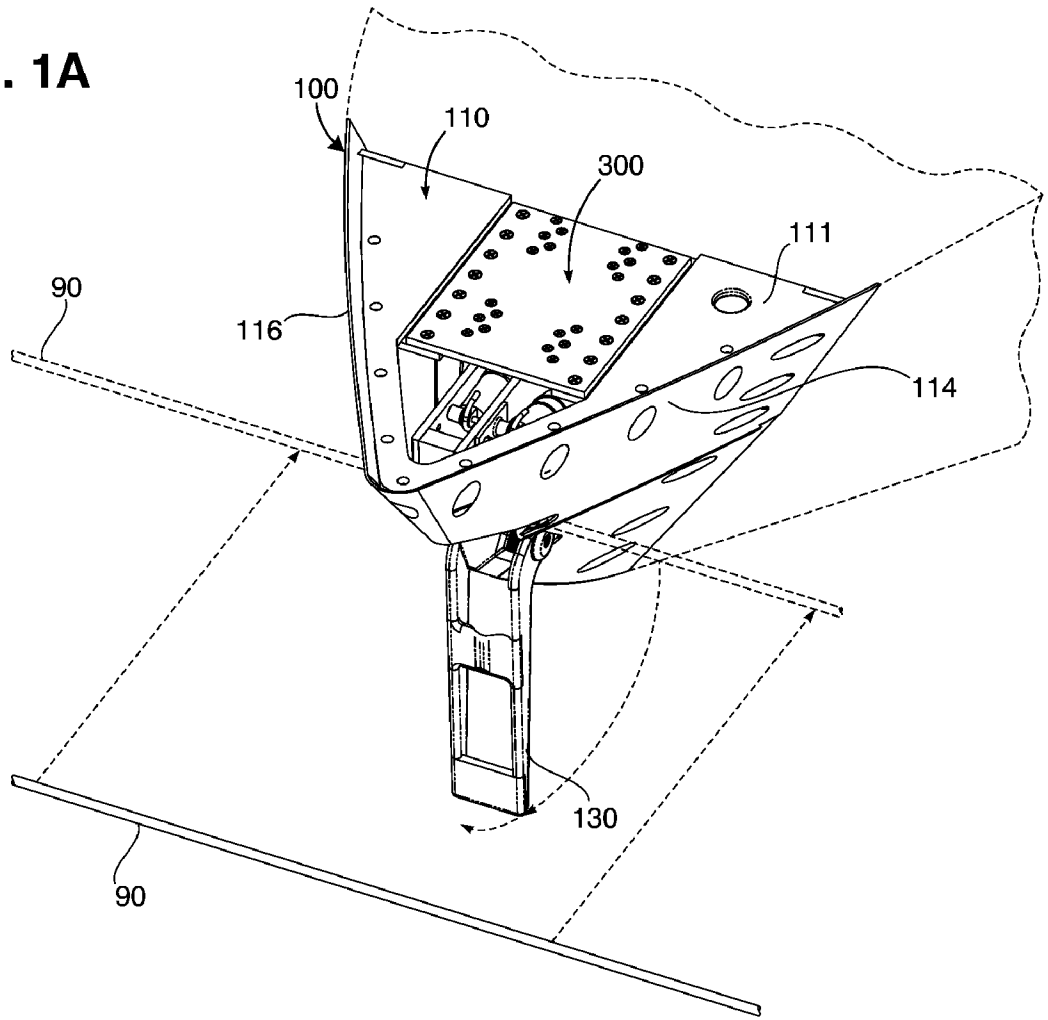
FIG. 1A is an exemplary perspective forward view of a hull-insertable line-capturing device, according to an embodiment of the invention.
Figure 1B:
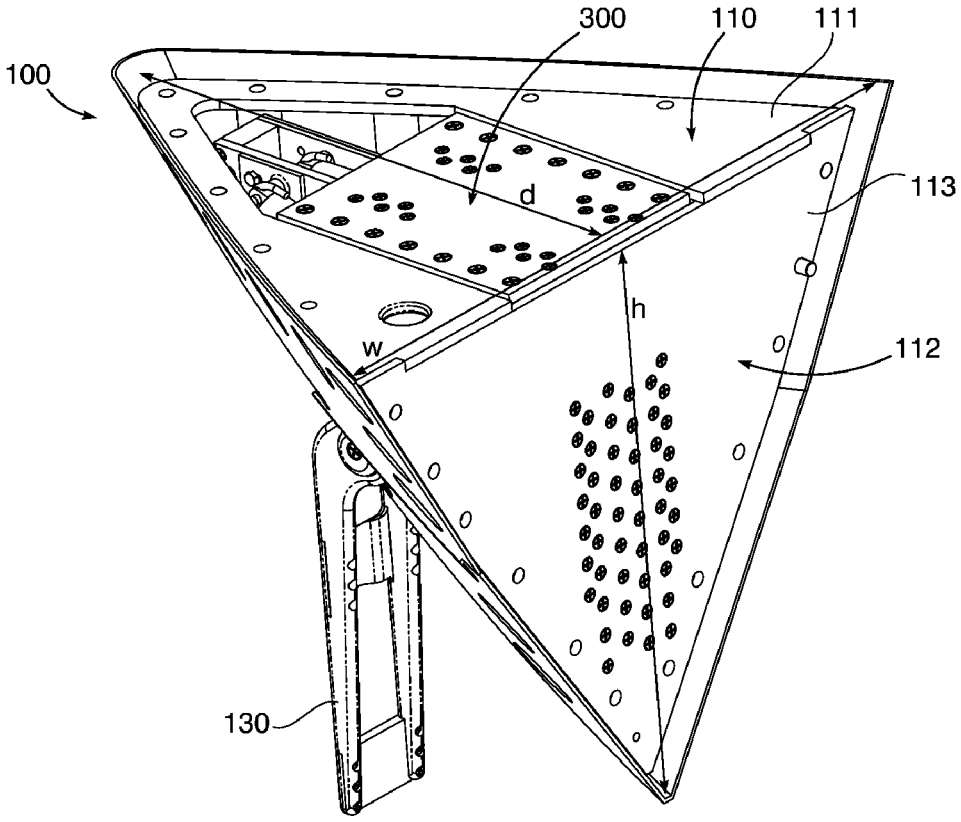
FIG. 1B is an exemplary perspective rear view of a hull-insertable line-capturing device, according to an embodiment of the invention.

FIGS. 1A and 1B are exemplary perspective illustrations of a hull insertable line-capturing device 100 for mooring a water vessel 101, according to an embodiment of the invention. The hull insertable line-capturing device 100 is for releasably capturing a line 90. The line 90 may be a rope, a cable, or the like, and may be made from any desired material, such as nylon for example. As will be outlined below with respect to FIG. 1D, the line-capturing device 100 is positioned within the hull of the water vessel 101. This enables the water vessel 101 to releasably capture the line 90 in the open water, allowing the water vessel 101 to be safely tethered or towed by the line 90 onto a parent watercraft 94. The vessel 10 may releasably capture a line 90 at the water surface 88, below the water surface, or suspended above the water surface 88 shown as the dashed line 90' in FIG. 1D.

Figure 1C:
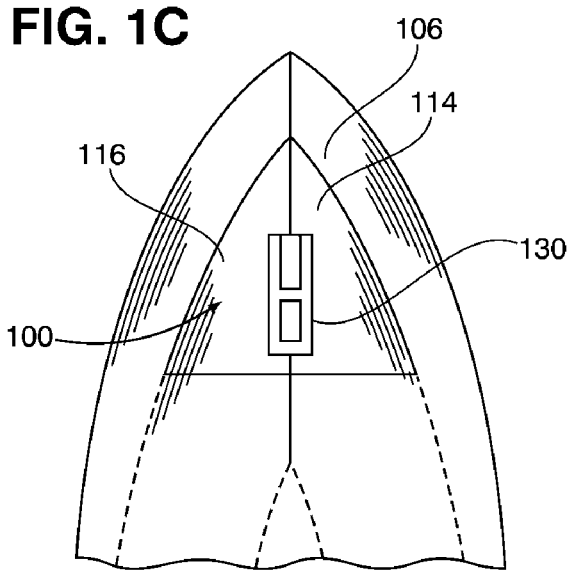
FIG. 1C is an exemplary bottom view of a hull-insertable line-capturing device, according to an embodiment of the invention.

FIGS. 1A-1C show the pyramidal shape of the hull insertable line-capturing device 100. The device 100 has a housing having four sides, with FIGS. 1A and 1B showing at least three of those four sides. It is understood that a first hull surface 114 shown in FIG. 1A is substantially identical to a second hull surface 116 opposite thereto. As shown, the device 100 includes a first planar surface 110, the first planar surface being substantially triangular. FIG. 1C further shows a first hull surface 114, and a second hull surface 116. The first hull surface 114 and the second hull surface 116 combine to form a continuous water vessel bow surface. As outlined below, the continuous water vessel bow surface of 114 and 116 is commensurate with the bow surface of a water vessel 101 to which the device 100 is attached. Thus, although shown as being curved in FIG. 1C, surfaces 114 and 116 may be more planar or more rounded, depending on the topography of the hull of the water vessel 101 to which the device 100 is attached. The hull insertable line-capturing device 100 further includes a second planar surface 112, which is also substantially triangular as shown in FIG. 1A. As outlined above with respect to surfaces 114 and 116, depending on the application, the first and second surfaces 110 and 112 may have shapes other than substantially triangular, such as for example, a rounded bilge hull shape.

FIG. 1B shows the hull-insertable line-capturing device 100 having connection plates 111 and 113 being a part of the device housing 101. The connection plates 111 and 113, which are located on the first and second planar surfaces 110 and 112 respectively, are for connecting the device 100 to a mating connector within the hull of a water vessel 101. FIGS. 1A-1C show the internal assembly 300 mounted within the hull-insertable device 100. The internal assembly 300, as outlined below, includes the working parts of the line-capturing device 100. Also shown is a pivotally attached guide arm 130, which is a part of the internal assembly that extends from the housing at a location where the first and second hull surfaces 114 and 116 meet. FIG. 1B also shows the hull insertable line-capturing device having a height h, a width w, and a depth d. The values of h, w, and d are selected to provide a proper fit within the water vessel to which the device 100 is attached.

Figure 1D:
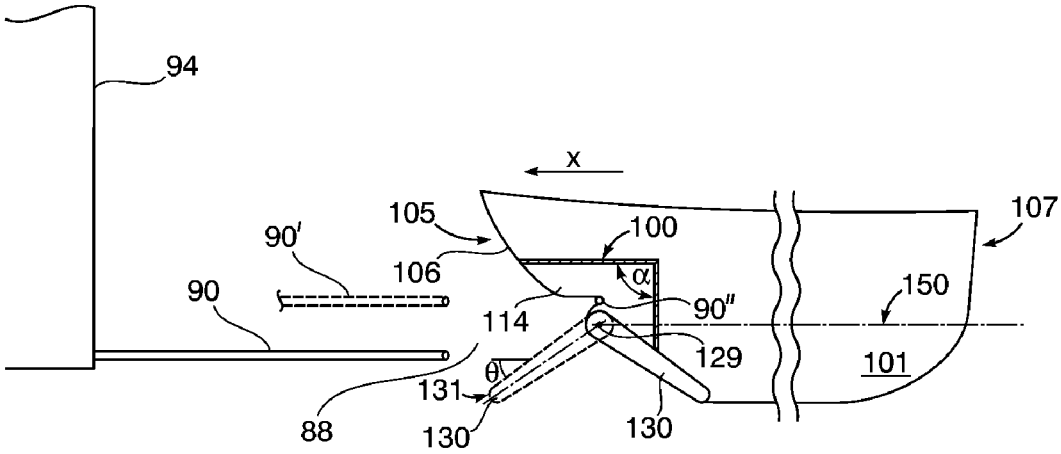
FIG. 1D is an exemplary side view if a system for releasably latching a smaller vessel to a parent vessel, according to an embodiment of the invention.

FIG. 1D is an exemplary illustration of a water vessel 101 with a hull insertable line-capturing device 100, according to an embodiment of the invention. The water vessel 101 may be any desired surface watercraft. In one embodiment, the water vessel is an unmanned surface vessel having a length of about 15 ft to about 50 ft long. As shown, the water vessel 101 has a bow end 105 and an aft end 107. The hull insertable line-capturing device 100 is attached at the bow end 105 of the vessel. The device 100 is inserted into a step cutout portion 140 at the bow end 105 of the hull, shown in FIG. 1E. FIG. 1D also shows a parent vessel 94 with a line 90 attached thereto for being received and latched by the device 100 of the water vessel 101

Figure 1E:
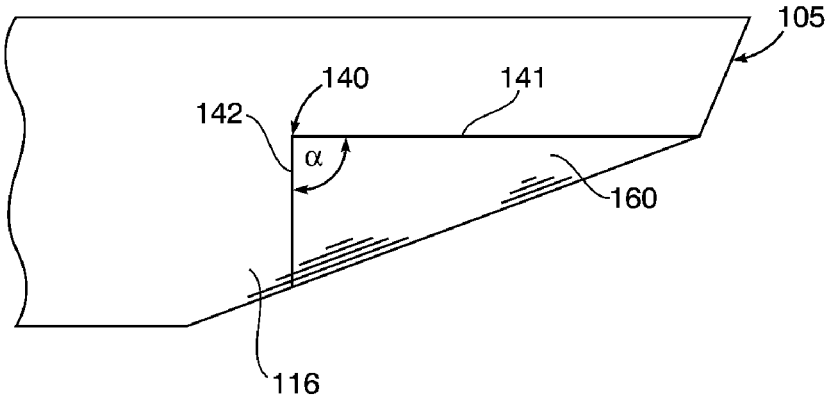
FIG. 1E is an exemplary illustration of a modular water vessel with a hull covering for operation without an insertable line-capturing device, according to an embodiment of the invention.

In order to provide a proper fit, the first and second planar surfaces 110 and 112 of device 100 have shapes and dimensions that match mating cutout surfaces 141 and 142 shown in FIG. 1E. Surfaces 141 and 142 are substantially triangular. The dimensions h, d, and w of the hull insertable line-capturing device substantially match the dimensions of cutout surfaces 141 and 142. The ratio of the height h to the depth d to the width w may be about 20:21:25. In one particular embodiment, the device 100 has a height h of about 27.5 inches, a depth d of about 29 inches, and a width w of about 34.5 inches. Therefore in this embodiment, the cutout surfaces 141 and 141 would have substantially similar height, width, and depth values. As outlined above, the first and second planar and substantially triangular surfaces 110 and 112 include respective connection plates 111 and 113 for connecting the device 100 to a mating connector within the hull at surfaces 141 and 142. Known attachment mechanisms such as screws, bolts, adhesives, and the like may be used to attach the connection plates 111 and 113 to mating connectors at cutout surfaces 120 and 122. As outlined above with respect surfaces 110 and 112, depending on the application, the hull cutout surfaces 141 and 142 may have shapes other than substantially triangular, such as for example, a rounded bilge hull shape.

FIG. 1C also shows first and second hull surfaces 114 and 116, which form a continuous hull surface with the surrounding bow surface 106. FIG. 1D also shows the pivotally attached guide arm 130. The guide arm 130 is shown in a retracted/stowage position (solid lines) and in a deployed position (dashed lines). As shown, in the retracted position, the guide arm 130 conforms to the shape of the surrounding bow surface 106. The conforming shape of the guide arm 130 in the retracted position, in combination with the conforming first and second hull surfaces 114 and 116 of the device 100 function to minimize drag and to optimize the performance of the water vessel 101 when line catching functions are not being performed.

FIG. 1D shows a waterline 150 which is located at about the level at which the guide arm 130 is hinged to the device housing at 129. The waterline 150 is generally at or about the water surface level 88. In the deployed position (dashed lines) the pivotally attached guide arm 130 is angled like a forward ramp, with the lower end 131 below the waterline 150. FIG. 1D shows the guide arm 130 in the deployed position making an angle θ with a horizontal vessel axis. In one embodiment, angle θ is about 40 degrees to about 60 degrees. In one particular embodiment, angle θ is about 50 degrees. As will be outlined below, during a line-capturing procedure, the water vessel 101 travels in direction X, shown in FIG. 1D. The water vessel 101 may travel at any acceptable velocity during line-capturing procedures, for example 3 knots to about 12 knots or more. FIG. 1D shows the line 90 captured in the device at 90".

The positioning of the lower end 131 below the waterline 150, allows the guide 130 to scoop up any line 90 floating at the surface of the water or below the surface 88. During line capturing operations the water vessel 101 may pitch and heave, resulting in the guide 130 bobbing above and below the water surface 88. Thus, a line that is suspended above the surface 88, as shown at 90', may also be guided up by the guide arm 130 into the device these circumstances. Alternatively, the line 90, at the surface 88, below the surface 88, or above the surface 88, may contact the vessel 101 at the bow end 105 at or above the device 100. In these situations, the downward slope of the bow may itself guide the line into the device 100. Alternatively, the line may enter the device directly, without guidance from the guide arm 130 or the bow surface. It is preferred that the line may be preferably presented at an angle of about 45 degrees to about 90 degrees relative to the direction of motion X of the watercraft. However, the line may be presented at other angles outside this range. Also, when presented above the water, the line may be suspended by an appropriate device, in a clothes-line manner, at a height of about 0.5 ft to about 2.5 ft above the water. As shown, the guide arm 130 has a smooth profile to ensure that the line is not snagged on the guide arm 130 while it is being scooped up off the water along the length of the guide arm 130. To withstand strong forces, the guide arm, along with other elements of the line-capturing device 100, may be made from sturdy materials, including metals such as titanium for example.

Figure 1F:
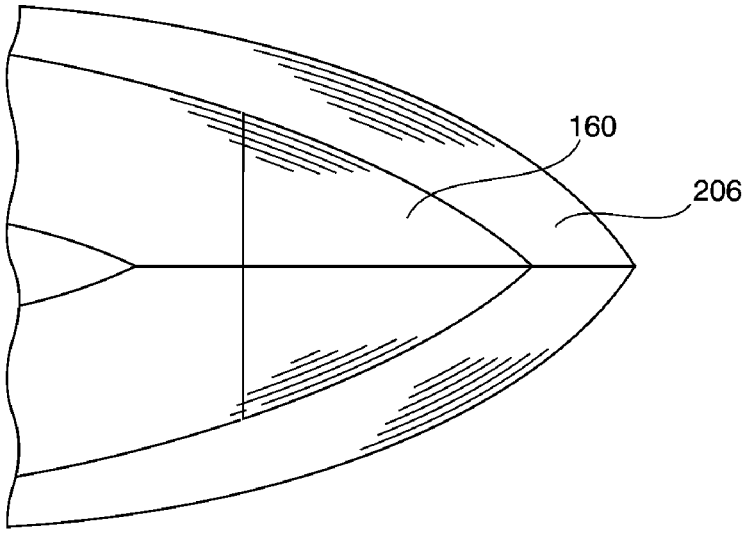
FIG. 1F is an exemplary bottom view of the hull of FIG. 1F, according to an embodiment of the invention

FIGS. 1E and 1F are exemplary illustrations of a modular surface water vessel 101 with a bow cover 160 for operation when the hull insertable line-capturing device 100 is not attached to the hull. As outlined above, FIGS. 1E and 1F show the hull 101 having a bow end 105. FIGS. 1E and 1G also show the abovementioned step cutout 140, with planar and substantially triangular surfaces 141 and 142. As shown, the angle between the planar surfaces 141 and 142 is α. The angle α may be about 60 degrees to about 120 degrees. Device 100 having other α values outside this range may also be used. FIGS. 1E and 1F show a bow cover 160 for providing a substantially watertight covering over the step cutout 140. The bow cover 160 may be employed in situations in which the water vessel 101 operates without the line-capturing device 100. The cover 160 may be machined to conform to the shaped of the hull to which it is attached, and may be made from known hull materials, such as fiberglass, aluminum, steel, and the like.

Figure 2A:
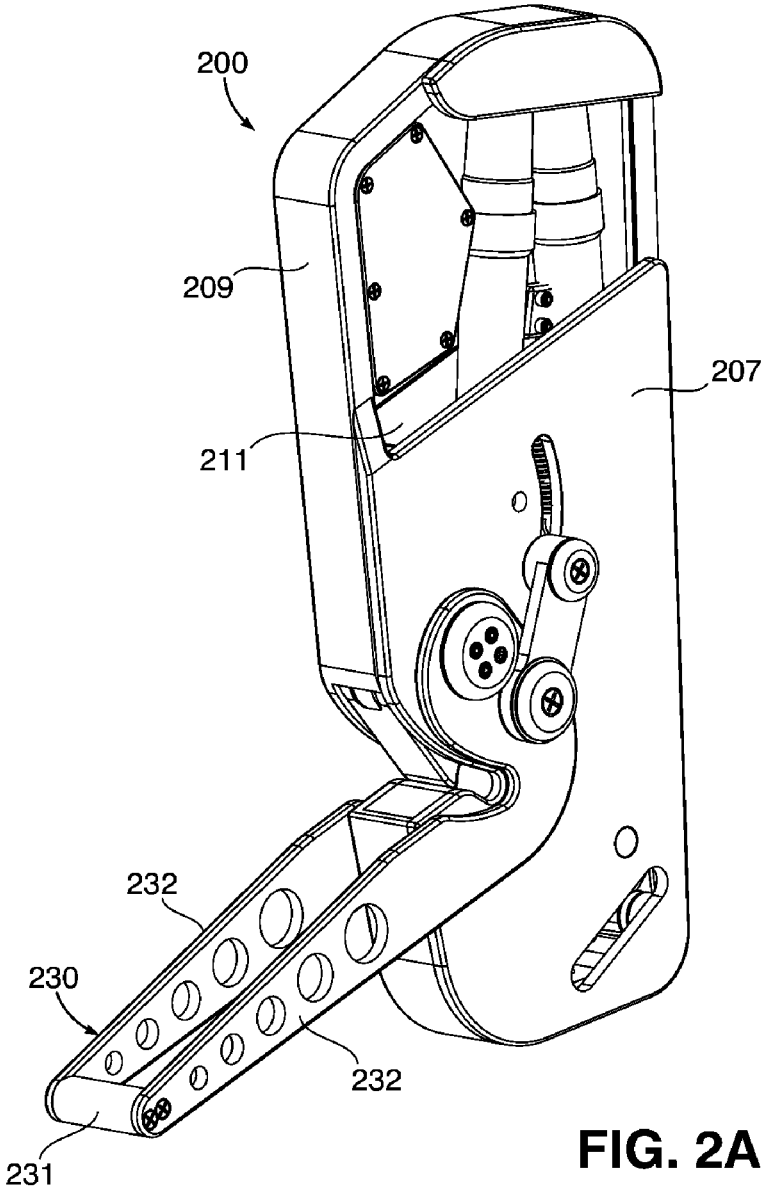
FIG. 2A is an exemplary illustration of an external line-capturing device, according to an embodiment of the invention.
Figure 2B:
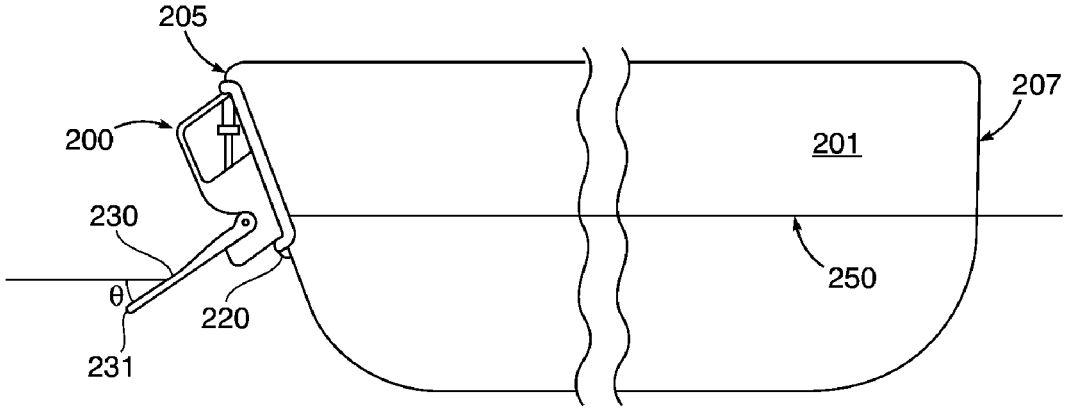
FIG. 2B is an exemplary illustration of a water vessel with an external line-capturing device, according to an embodiment of the invention.

FIG. 2A is an exemplary illustration of an external line-capturing device 200, according to an embodiment of the invention. The external line-capturing device 200 releasably captures a line and operates similarly to the internal hull insertable device 100 discussed above. As outlined above, the line 90 may be a rope, a cable, or the like, and may be made from any desired material, such as nylon for example. FIG. 2B shows the line-capturing device 200 externally attached to the hull of a water vessel 275. This enables the water vessel 275 to releasably capture the line 90 in the open water, allowing the water vessel 101 to be safely tethered or towed by the line 90.

FIG. 2A shows the external line-capturing device 200 having a cassette-like housing. The housing, which as shown is substantially rectangular in shape, includes a narrow flat connection strip 209 forming the border of the cassette-like housing. The flat connection strip 209 may be a plurality of connected strips arranged in an end-to-end manner. The housing also includes a first flat broad outer plate 207, which is attached along a first of two outer edges of the connection strip 209. The housing also includes a similar broad outer plate 207 (not shown) attached to the other outer edge of the connection strip, the two broad outer plates mounted substantially parallel to each other, enclosing the cassette-like housing. The plate may take various forms. As shown in FIG. 2A, the plates do not extend along the entire outer edge of the strip 209, and may leave a window portion 211. The device 200 also includes a pivotable elongated guide arm 230, pivotally attached to outer plates 207. The guide arm 230 includes a lower end connector 231 and two outer side strips 232. FIG. 2A shows the guide arm 230 in a deployed position, but the guide arm 230 may be retracted so that the outer side strips 232 do not extend from the plates 207, but are pulled adjacent to the plates 207. It should be noted that line capturing device 200 may take different forms or shapes, to the extent that the internal working elements allow.

FIG. 2B shows the line-capturing device 200 attached to a water vessel 201. As shown, the water vessel 201 has a hull having a bow end 205 and an aft end 207. The external line-capturing device is attached at the bow end 205 of the hull by means of a mounting bracket 220. The water vessel 201 may be any type of water vessel in which towing or tethering is desired. In one particular embodiment, the water vessel is unmanned surface vessel having a length of about 15 ft to about 50 ft, having a substantially vertical bow end.

FIG. 2B shows a waterline 250, which is located at about the level at which the guide arm 230 is hinged to the device housing at 229. FIG. 2B also shows the guide arm 230 in a deployed position, angled like a forward ramp, with a lower end 231 below the waterline 250. Similar to the arrangement of FIG. 1D, the guide arm 230 is angled downwards so that it makes an angle θ with a horizontal vessel axis. In one embodiment, angle θ is about 40 degrees to about 60 degrees. In one particular embodiment, angle θ is about 50 degrees.

Similar to the embodiment of FIG. 1D, the positioning of the lower end 231 at or below the waterline 250, allows the guide 230 to scoop up any line 90 floating at or below the surface of the water. During line capturing operations the water vessel 201 may pitch and heave, resulting in the guide 230 bobbing above and below the water surface. Thus, a line 90 that is suspended above the water may also be guided up by the guide arm 230 in these circumstances. Alternatively, in instances when the line strikes the vessel 201 high at the bow end 205, at or above the device 200, the downward slope of the bow may itself guide the line into the device 200. Alternatively, the line 90 may be presented so that the line 90 enters the device 200 directly, without guidance from the guide arm 230 or the bow. During line-capturing operations while travelling in direction X, the water vessel 201 may travel at any desired speed, such as 3 knots to about 12 knots or greater. Also, the guide arm 230 has a generally smooth profile to ensure that the line is not caught on the guide 230 during the capturing process. The guide arm 230 may be made from sturdy materials, such as titanium and the like.

Figure 3A:
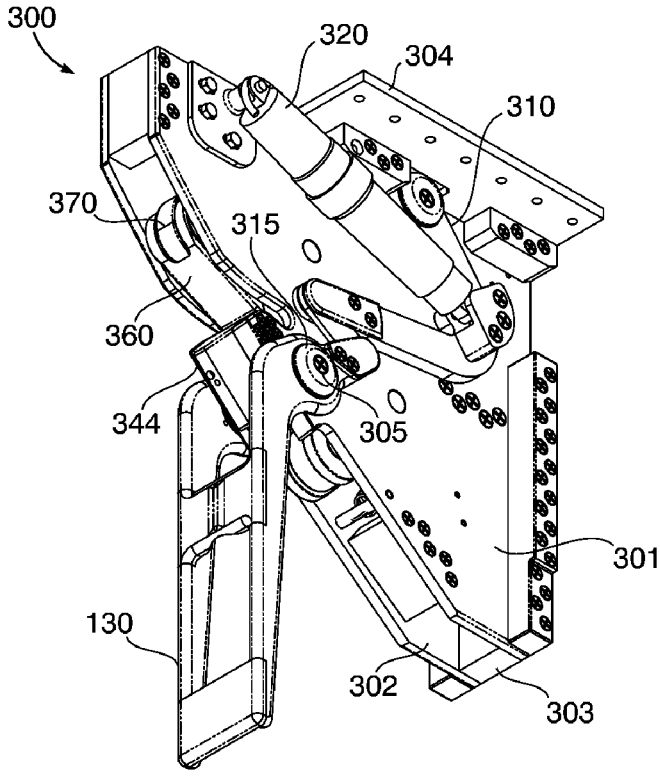
FIG. 3A is a perspective illustration of the internal assembly of a hull-insertable line-capturing device, according to an embodiment of the invention.
Figure 3B:
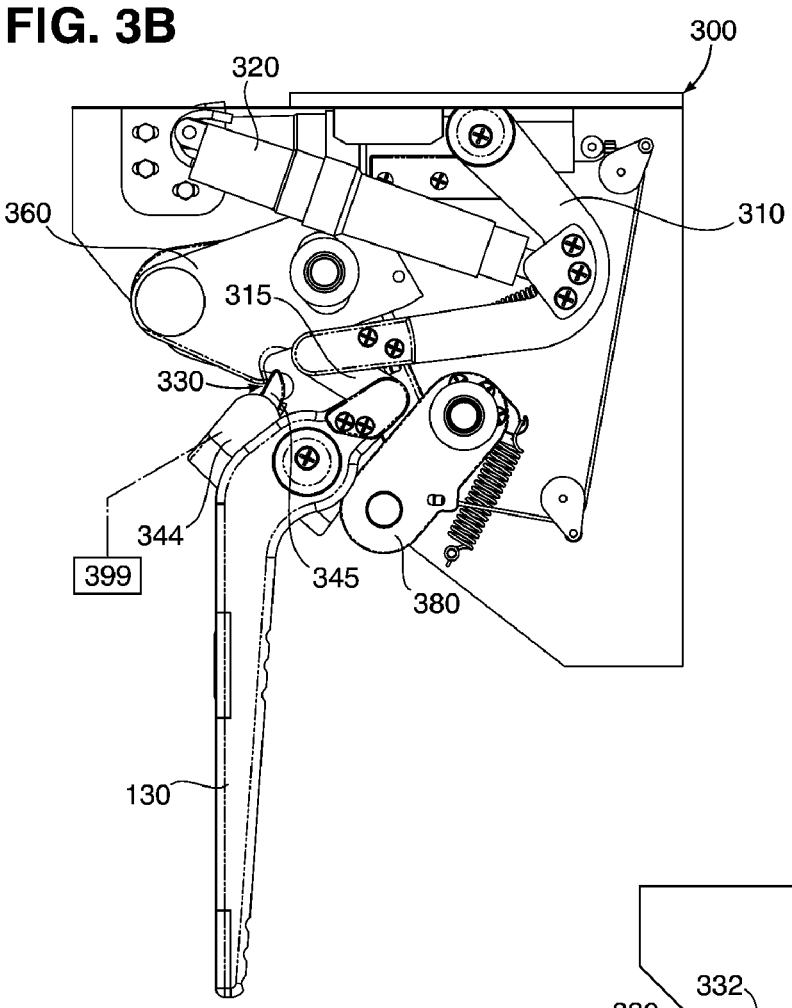
FIG. 3B is a sectional illustration of the internal assembly of a hull-insertable line-capturing device, according to an embodiment of the invention.

FIGS. 3A and 3B show the internal assembly 300 of the line-capturing device 100, according to an embodiment of the invention. FIG. 3A shows the internal assembly 300 having an inner housing frame that includes first and second vertical plates 301 and 302. The frame further includes a back plate 303, and a top mounting plate 304. Each of the plates 301, 302, 303, and 304 may be formed using one or more plates. FIGS. 3A and 3B show the guide arm 130 pivotally attached to vertical plates 301 and 302 about a pivot pin 305. As shown, the guide arm 130 has a smooth streamlined profile for conforming to the shape of a vessel hull and for smoothly guiding a line into the mechanism. The guide arm 130 along with inner housing frame elements such as the first and second vertical plates 301 and 302 may be made from materials such as titanium and the like, so as to enable the device to withstand large hydrodynamic forces.

FIGS. 3A and 3B also show components for manipulating the movement of the guide arm 130 about the pivot pin 305. A C-link 310 is shown that is connected to a short link 315 at the lower end of the C-link 310. The short link 315 is connected to the guide arm 130. As shown, an actuator 320 is attached to the elbow region of the C-link 310. The actuator 320 may be a pneumatic actuator or the like, having an arm that extends and retracts to rotate the guide arm 130 between a deployed position and a retracted or stowed position, via the C-ling 310 and the short link 315. It should be noted that in the FIGS. 3A and 3B illustrations, the guide arm 130 is not in either the fully-deployed or fully-retracted positions, but is in an intermediate position.

Figure 3C:
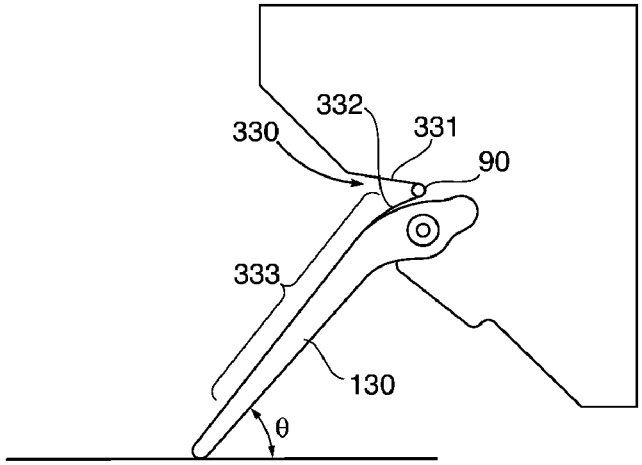
FIG. 3C is an illustration of a deployed guide arm forming an extension of the lower lip portion in a hull-insertable line-capturing device, according to an embodiment of the invention.

FIGS. 3A-3C also show a substantially V-shaped notch 330 for capturing a line 90 therein. The substantially V-shaped notch 330 is formed within inner housing vertical plates 301 and 302. As shown, the substantially V-shaped notch 330 includes a top lip portion 331 and a lower lip portion 332. FIG. 3C shows the guide arm 130 extending in a deployed position at an angle θ of about 40° to about 60° to a horizontal vessel axis. As shown, in the deployed position the guide arm 130 forms a continuous extension 333 of the lower lip portion 332 of the substantially V-shaped notch 330. In operation, a line 90 that is scooped up by the guide 130 is directed up the guide 130 into the substantially V-shaped notch 330 for capturing the line 90 in a latching mechanism thereafter. The smooth profile of the extended lower lip portion 333, which extends into the substantially V-shaped notch, optimizes the efficiency of the line-capturing process.

Returning to FIGS. 3A and 3B, the internal assembly 300 of the hull insertable line-capturing device 100 further includes a sensor 344. Sensor 344 is located about the apex of the substantially V-shaped notch 330, where the line 90 is captured by a pawl, as discussed below. The sensor 344 is provided to detect the presence of a captured line. Upon detecting the captured line, the sensor 344 sends a signal to a vessel control 399, indicating that a line has been captured. This allows an operator of the water vessel to adjust the operation thereof.

FIG. 3B shows a line sensor 344 having a sensor finger arrangement 345 that is biased forward. As will be outlined below, a captured line 90 is detected when the line 90 pushes the finger arrangement 345 backwards, or into the internal assembly 300. The detection signal is completed by means of a magnet in the finger 345. When pushed backwards by the line 90, the magnet in the finger arrangement 345 is moved into alignment with an open reed or proximity switch, which closes the connection and provides the detection signal. The line sensor 344 may be dimensioned to capture a line 90 of any desired size. In one preferred embodiment, the sensor 344 is sized to capture lines of about 0.375 in to about 0.75 in. In this embodiment, the finger arrangement 345 may be a two lever arrangement having an upper lever and a lower lever. The upper lever contacts the line 90 and the lower lever carries the magnet. The two levers may be hinged on the same shaft and may be fitted with an elastic connection arranged such that the lower part is fully displaced and in contact with a hard stop when the smallest line 90 is in the latch.

Figure 3D:
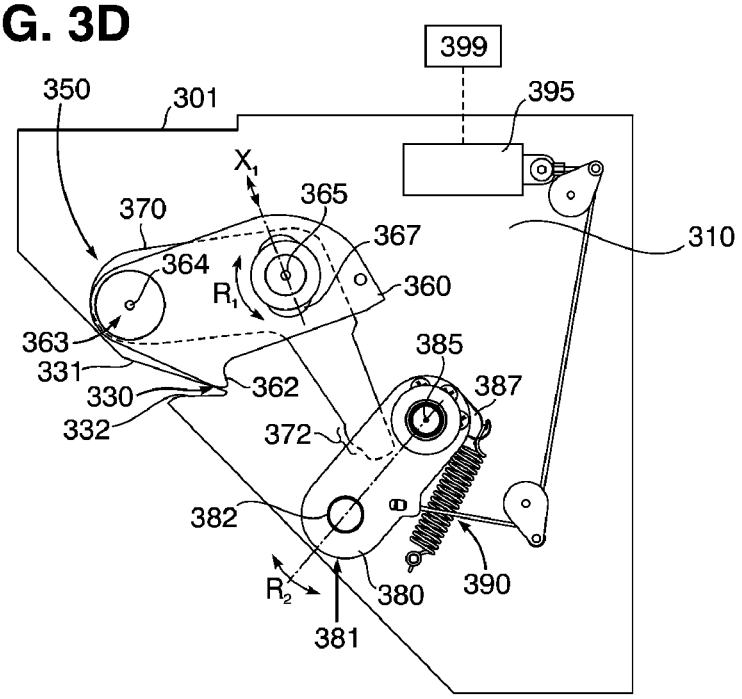
FIG. 3D is an exemplary illustration of a latching arrangement of a hull-insertable line-capturing device, according to an embodiment of the invention.

FIG. 3D is a schematic illustration of a latching mechanism 350 of the hull insertable line-capturing device 100, for releasably securing a line 90. The latching mechanism 350 includes a three-link arrangement including a gravity-assisted pawl 360, a release lever 370, a biased link 380, and a biasing arrangement 390. Like other device elements, the pawl 360, the release lever 370, and the biased link 380 may all be formed of a material such as titanium and the like in order to properly withstand large forces. FIG. 3D also shows schematically an electrical actuator 395. The pawl 360 functions to capture a line 90 at the inner housing of the internal arrangement 300. The line 90 is captured at about the apex of the substantially V-shaped notch 330 between pawl pinching notch 362 inner housing plates 301 and 302.

FIG. 3D shows the pawl 360 attached to the release lever 370. The pawl 360 includes a receiving hole 364 at a forward end and an elongated receiving slot 367 at an aft end. The pawl 360 is attached to the release lever 370 at a first point 363 and a second aft point 365. Pivot pins or the like may be used to connect the pawl 360 to the release lever 370 at each of the first and second points 363 and 365. Thus for example, when pivot pins are used, a first pin would extend through the receiving hole 364 at the forward point 363 and a second pin would extend through the elongated receiving slot 367 at the aft point 365. The pawl 360 may preferably include bearings on the inner walls at points 363 and 365. The bearings may be journal bearings, bushings, and the like, and combinations thereof. It should be noted that the pawl 360 may have a vertical slot (not shown) in which the release lever 370 fits.

At point 363, the pawl 360 and the release lever 370 are attached to each other and not the inner housing plates 301 and 302. Thus the pawl 360 and the release lever 370 are pivotable with respect to each other, but freely movably within the housing, to the extent that the connection at point 365 allows. With respect to the attachment at point 365, the attachment element, such as the pivot pin extends all the way through to inner housing plates 301 and 302. Thus movement of pawl 360 with respect to the inner housing, as well as the movement of the release lever 370 with respect to the inner housing is restricted. The release lever 370 can only pivot about point 365 in the arc $R_1$ shown in FIG. 3D. At point 365 the pivot pin extends through the elongated slot 367 of the pawl 360. Thus, even though motion is restricted relative to the inner housing, the pawl 360 is slidable in direction $X_1$, as well as pivotable in arc direction $R_1$. Because of the arrangement outlined above, the pawl 360 is predisposed under the force of gravity to be in a latching position, as schematically shown in FIG. 3E.

FIG. 3D shows the biased link 380 attached to the biasing arrangement 390 via attachment hook 387. The biased link 380 is pivotally attached to one or both of the inner housing plates 301 and 302 by means of a pivot pin or the like at point 385 at the aft end of the link 380. The biased link 380 may also include bearings for proper interaction with the pivot pin or the like. The biased link 380 is pivotable about 385 in arc direction $R_2$, and is predisposed to have the forward free end 381 biased upwards as shown in FIG. 3E. The biasing arrangement 390, which is actuated by actuator 395, manipulates the positioning of the biased link 380. An actuation signal may be sent to the actuator 395 via the vessel controller 399. Vessel controller 399 may be controlled in various ways. For example, the controller 399 may be controlled by an operator on the vessel containing device line capturing device 100 or it may be controlled remotely by an operator remote from the vessel containing line capturing device 100, such as an operator on a larger parent ship that receives the smaller vessel. The controller 399 may alternatively be controlled by an operator on land or in the air.

When manipulated, the biased member 380 affects the positioning of the gravity-assisted locking pawl 360, via the release lever 370. FIG. 3E shows the three-link arrangement with the pawl 360 in a predisposed latched position. As shown in FIGS. 3D and 3E, the release lever 370 includes a camming surface 372 at an elongated lower end. Depending on the positioning of the release lever 370, an inner guide roller 382 meshes with the camming surface 372. FIG. 3E shows the inner guide roller 382 engaged at the camming surface 372. In this position, the release lever 370 is prevented from rotating forward in the $Y_1$ direction, and holds the pawl 360 in a position so that gravitational forces bear down on the pawl 360 maintaining the pawl 360 in the latched position.

Figure 3E:
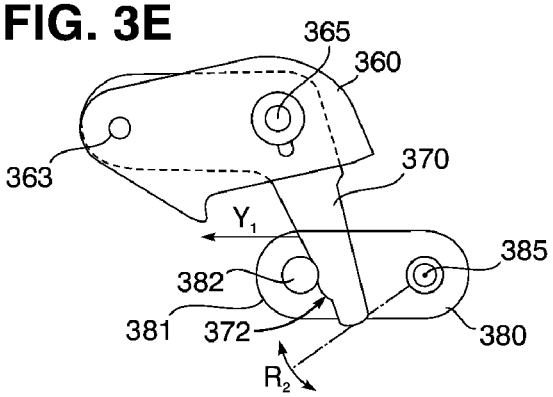
FIG. 3E is an exemplary illustration of a three-link arrangement in a latched orientation, according to an embodiment of the invention.

In operation, as stated above, the pawl 360 is predisposed under the forces of gravity to be in a position that enables latching, as shown in FIG. 3E. The pawl 360 relies on gravity and the force of the line 90 for its actuation. When a line 90 such as a cable or rope or the like is scooped up by the guide arm 130, the line 90 enters the inner housing at the substantially V-shaped notch 330 where the line 90 contacts the pawl 360. When the pawl 360 engages the line 90, the pawl is displaced upwards, rotating around the first pivot pin at 363 until the line 90 can pass between the lower edge of the pawl 360 and the lower lip region 332 of the housing directly below the pawl 360. After the line 90 passes under the pawl 360, the pawl 360 is returned to the latched position by the force of its own weight. Subsequent to latching, an operator may actuate the biasing arrangement 390 via the actuator 395 and the controller 399, which then pivots the biased link downwards in a counterclockwise direction in the $R_2$ arc, allowing the forward end of the release lever 370 at 363 to rotate upwards in a clockwise direction in arc $R_1$ about pivot point 365. When this happens, the pawl 360 moves together with the release lever 370 enabling the pawl 360 to release the line 90.

Energy to accomplish the release of the line 90 is supplied by the line 90 itself. If there is no tension in the line 90, then the pawl 360 and release lever 370 will not be rotated as described above, and the line 90 will not be released from the device, even though the actuator 395 prepares the pawl 360 to release the line 90. Thus, a slack line 90 will not be released. This is desirable because a slack line 90 if released may be run over by the parent or host vessel that extends the line 90 for receiving the vessel carrying the device 100. It should be noted that the three-link latching arrangement (360, 370, and 380) and the substantially V-shaped notch 330 may be dimensioned to releasably capture a line 90 of any desired size. In one particular embodiment, the three-link latching arrangement (360, 370, 380) and the notch 330 are dimensioned to capture a line 90 having a diameter of about 0.375 inches to about 0.750 inches.

Figure 4:
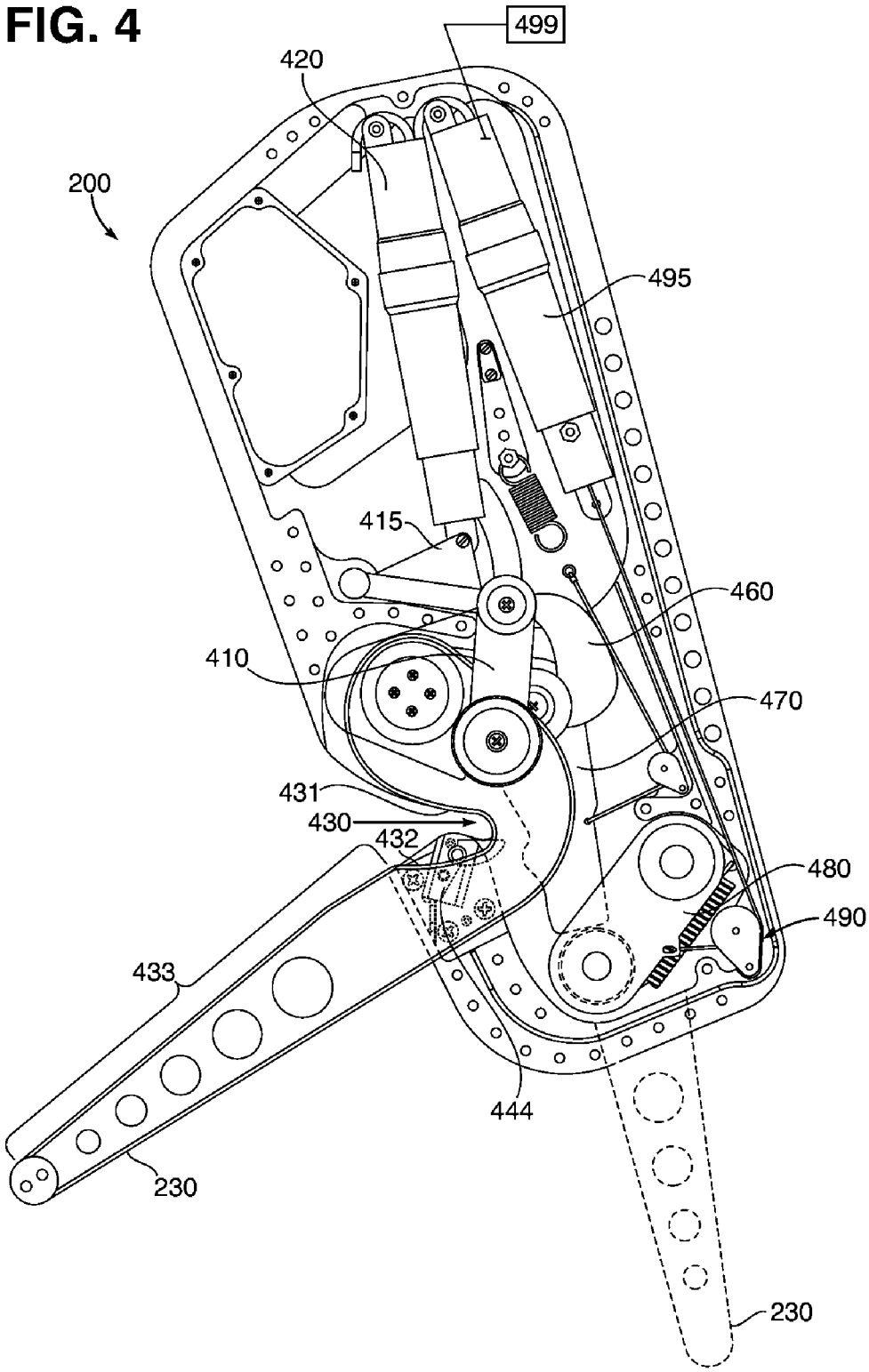
FIG. 4 is an exemplary illustration of an external line-capturing device, according to an embodiment of the invention.

FIG. 4 is a sectional illustration of an external line-capturing device 200, according to an embodiment of the invention. As shown, the housing has a substantially rectangular shape. The external line-capturing device 200 is similar to the hull insertable line-capturing device 100, having similar elements that operate similarly. FIG. 4 shows the guide arm 230 in an extended deployed position forming a smooth extended lower lip portion 433 with a lower lip 432 portion of a substantially V-shaped notch 430. FIG. 4 also shows the upper lip portion 431 of the substantially V-shaped notch 430. FIG. 4 further illustrates arm links 410 and 415, with link 410 attached at one end to the guide arm 230 and at the other end to link 415. An actuator 420 including extendable arm is attached to link 415 for the purpose of pivoting the guide arm 230 from a retracted/stowed position, shown in dotted lines in FIG. 4A, to the deployed position. A line sensor 444 is also shown. According to the present embodiment, the guide arm 230 can be extended and retracted while a line 90 is latched. The guide arm 230 is mounted so that it never crosses the substantially V-shaped notch.

FIG. 4 also includes a three-link latching arrangement, including a gravity-assisted pawl 460, a release lever 470, and a biased link 480. The biased link 480 is attached to a biasing arrangement 490 which may include a return spring, which in turn, is attached to an electrical actuator 495. As shown, the actuator 495 is attached to a vessel controller 499. With respect to the latching mechanism, it should be noted that similarly numbered elements of the external device 200, operate in the same manner outlined above for similarly numbered elements of device 100. Thus for example, the latching arrangement elements 460, 470, 480, 490, and 495, operate in substantially the same manner outlined above for latching arrangement elements 360, 370, 380, 390, and 395, respectively.

Figure 5A:
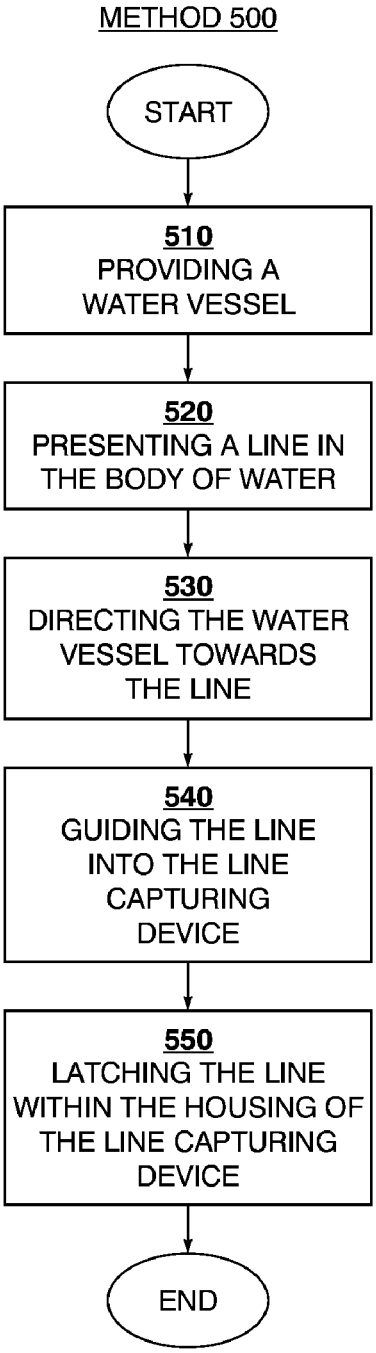
FIG. 5A is a flowchart illustrating a method of releasably capturing a line in open water according to an embodiment of the invention.

FIG. 5 is a flowchart illustrating a method 500 of releasably capturing a line 90 in water. The steps involved in the method 500 of releasably capturing a line 90 in water have been outlined above in detail in the description of FIGS. 1A-4. Step 510 includes providing a water vessel (101, 201) on the water, the water vessel being any of the abovementioned water vessels outlined above. The vessel may have any desired size. In one particular embodiment, the water vessel may be an unmanned surface water vessel having a length of about 15 feet to about 50 feet.

The water vessel (101, 201), as illustrated above, includes a hull body having a bow end (105, 205) and an aft end (107, 207). A line-capturing device (100, 200) is attached to the hull body at the bow end. The line-capturing device may have a housing having a substantially V-shaped notch therein, and a hinged guide arm pivotally attached to the housing. According to an embodiment of the invention, the hinged guide arm is pivotable between a stowed position and a deployed position.

Step 520 includes presenting a line 90 in the body of water. (See FIG. 5B.) As outlined above the line 90 may be a rope, a cable, or the like, and may be made from any desired material, such as nylon for example. In one embodiment the line 90 may be laid floating at or below the water surface. In another embodiment, the line 90 may be presented suspended above the water in a clothes-line manner, at a height for example, of about 0.5 feet to about 2.5 feet above the surface of the water.

Figure 5B:
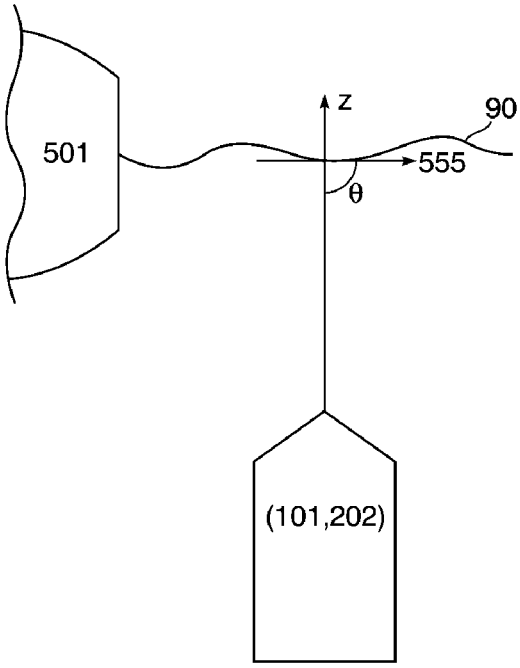
FIG. 5B is an exemplary illustration of a water vessel approaching a line during a line-capturing procedure, according to an embodiment of the invention.

Step 530 includes directing the water vessel (101, 201), bow-first towards the line 90. During a line-capturing process, the water vessel (101, 201) may travel at various speeds, including speeds of about 2 knot to about 12 knots. FIG. 5B is an exemplary schematic illustration of a water vessel (101, 201) travelling in direction Z, approaching a line 90 extended by a parent vessel 501, the line 90 having a line direction 555. FIG. 5B is essentially a schematic top view of FIG. 1D. As shown, the water vessel (101, 201) approaches the line direction 555 so that travel direction Z forms an angle δ with the line direction 555. Angle δ may be any desired angle, but may preferably be about 45 degrees to about 90 degrees.

Step 540 includes guiding the line 90 into the line-capturing device (100, 200). Because of the angled orientation of the deployed guide arm (130, 230) when the water vessel (101, 201) drives into the line 90, the guide arm scoops the line 90, up the smoothly profiled guide arm (130, 230), which forms a continuous lower lip portion with a lower lip of the substantially V-shaped notch (330, 430). As shown in FIGS. 1D and 2B, in the deployed position, the guide arm (130, 230) extends below the waterline which makes it possible for the guide arm (130, 230) to scoop a line 90 floating in the water. If the water vessel (101, 201) is pitching and heaving in higher sea state conditions, the location of the arm (130, 230) also allows for scooping of a line 90 suspended above the water surface, for example at about 0.5 ft to about 2.5 ft above the water. Alternatively, in instances when the line 90 strikes the vessel (101, 201) at the bow end (105, 205), at or above the device (100, 200), the downward slope of the bow may itself guide the line 90 into the line-capturing device (100, 200). Alternatively, the line 90 may be presented directly at the V-shaped notch (330, 430), and there may enter the device by being guided by the upper and lower lip portions.

Step 550 includes the latching of the line 90 within the housing. FIGS. 3D, 3E, and 4 show the latching arrangement within devices 100 and 200 that enable the releasable latching of the line 90. As outlined above, a gravity-assisted pawl (360, 460) securely captures the line 90 within the housing. Once the line 90 is captured, the water vessel (101, 201) may be tethered by the line 90, or may be lifted onto a parent watercraft. According to an embodiment of the invention, after the line 90 is captured the water vessel (101, 201) is be towed onto a parent watercraft in a recovery process. After towing or when tethering is no longer desired, an electric actuator (395, 495) associated with the latching arrangement may be triggered to release the line 90. The control of the actuator (395, 495) may be performed by an operator on the water vessel (101, 201). Alternatively, the operator may be at a remote location, such as on land, or in the air, or on the parent vessel 501. As outlined above, if there is no tension in the line 90, then the pawl 360 and release lever 370 will not be rotated as described above, and the line 90 will not be released. Thus, according to the method, only a tensioned line 90 is released.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A water vessel mooring device for releasably capturing a line for recovering a water vessel, the device comprising:

a housing having a line-capturing notch, the line-capturing notch having a top lip portion and a lower lip portion;

a hinged guide arm, to guide a line within the housing, pivotally connected to the housing, wherein the hinged guide arm is pivotable between a stowed position and a deployed position, and wherein in the deployed position the hinged guide arm forms a continuous extension of the lower lip portion; and a latching mechanism within the housing to secure the line within the housing, wherein the notch is substantially V-shaped, and wherein the latching mechanism includes a gravity-assisted pawl located at about the apex of the substantially V-shaped notch for engaging the line at about the substantially V-shaped notch.

2. The water vessel mooring device for releasably capturing a line of claim 1, wherein gravity-assisted pawl includes a forward end having a receiving hole, and an aft end having an elongated receiving slot, and wherein the latching mechanism includes a release lever for moving the gravity-assisted pawl from a predisposed rest position, the release lever attached to the gravity-assisted pawl at each of the forward end and the aft end, wherein at the forward end a pivot pin extends through each of the release lever and the receiving hole of the gravity-assisted pawl, and at the aft end a pivot pin extends through the housing, the release lever, and the elongated receiving slot of the gravity-assisted pawl.

3. The water vessel mooring device for releasably capturing a line of claim 2, the latching mechanism includes a biased link including a first end, a second end, the biased link pivotally attached to the housing at the second end, an attachment hook located at the second end of the biased link, and a roller at the first end of the biased link, the latching mechanism further including a biasing arrangement to control the movement of the biased link, the biased link attached to the attachment hook of the biased link, and an actuator to actuate the biasing arrangement, wherein the release lever includes an elongated lower end having a camming surface, which mates with the roller at the first end of the biased link, and wherein when the biasing arrangement is actuated, the biased link pivots about the second end and the roller at the first end rolls along the camming surface thereby promoting the rotation of the release lever about the second aft point.

4. The water vessel mooring device for releasably capturing a line of claim 3, further including a sensor positioned at the substantially V-shaped line-capturing notch, opposite the gravity-assisted pawl, wherein the sensor detects the presence of a line at the substantially V-shaped line-capturing notch.

5. The water vessel mooring device for releasably capturing a line of claim 1, wherein the housing has a pyramidal shape including a first substantially triangular surface, a second substantially triangular surface, a first hull surface, and a second hull surface, wherein the first hull surface and the second hull surface form a continuous water vessel bow surface, and wherein the hinged guide extends from the housing at a location where the first and second hull surfaces meet.

6. The water vessel mooring device for releasably capturing a line of claim 1, wherein the housing has a substantially rectangular shape including a first flat broad plate, a second flat broad plate positioned substantially parallel to the first flat broad plate;

a narrow flat connection strip looped to form the border of the substantially rectangular shape, the narrow flat connection strip having a first outer edge portion and a second outer edge portion, wherein the first flat broad plate is attached to the narrow flat connection strip along the first outer edge portion, and wherein the second flat broad plate is attached to the narrow flat connection strip along the second outer edge portion.

7. A water vessel for capturing a line for the mooring of the water vessel, the water vessel comprising:

a hull body including a stern end, and a bow end wherein the bow end of the hull body includes a step cutout portion bordered by a surrounding bow surface, wherein the step cutout portion includes a first substantially triangular bow surface within the hull body, and a second substantially triangular bow surface within the hull body, the water vessel further comprising a line capturing device having a housing, wherein the housing has a pyramidal shape including, a first substantially triangular surface aligned with the first substantially triangular bow surface of the step cutout portion, a second substantially triangular surface aligned with the second substantially triangular bow surface of the step cutout portion, a first hull surface, and a second hull surface, wherein the first hull surface and the second hull surface form a continuous water vessel bow surface with a surrounding bow surface of the water vessel.

8. A system for towing a smaller water vessel to a parent vessel, the system comprising:

a parent vessel having an attached line extending from the parent vessel; and a smaller water vessel having a line capturing device including a housing having a line-capturing notch having a top lip portion and a lower lip portion, a hinged guide arm, for guiding a line within housing, the hinged guide arm pivotally connected to the housing wherein the hinged guide arm is pivotable between a stowed position and a deployed position, wherein in the deployed position the hinged guide arm forms a continuous extension of the lower lip portion, and a latching mechanism within the housing at the line-capturing notch, wherein the latching mechanism clamps the line thereby attaching the smaller water vessel to the parent vessel.

* * * * *